US007118065B1

(12) United States Patent
Heitmann et al.

(10) Patent No.: US 7,118,065 B1
(45) Date of Patent: Oct. 10, 2006

(54) LATERAL THRUST CONTROL

(75) Inventors: Thomas Heitmann, Unterlüss (DE); Michael Schwenzer, Hermannsburg (DE)

(73) Assignee: Rheinmetall Waffe Munition GmbH, Aschau am Inn (DE)

( * ) Notice: Subject to any disclaimer, the term of this patent is extended or adjusted under 35 U.S.C. 154(b) by 172 days.

(21) Appl. No.: 10/990,970

(22) Filed: Nov. 18, 2004

(30) Foreign Application Priority Data

Nov. 19, 2003 (DE) ..... 103 54 098

(51) Int. Cl.
*F42B 15/01* (2006.01)

(52) U.S. Cl. ..... 244/3.22; 244/52; 102/347

(58) Field of Classification Search ..... 244/3.22, 244/52, 3.21, 3.1, 3.15, 3.16; 102/347–352
See application file for complete search history.

(56) References Cited

U.S. PATENT DOCUMENTS 3,034,434 A * 5/1962 Swaim et al. ..... 244/3.22
3,860,199 A * 1/1975 Dunne ..... 244/3.13
3,868,883 A * 3/1975 Tucker ..... 89/1.8
5,433,399 A 7/1995 Becker et al.
5,836,540 A * 11/1998 Romer et al. ..... 244/3.16
6,367,735 B1 4/2002 Folsom et al.
6,685,134 B1 * 2/2004 Trosky et al. ..... 244/3.22

FOREIGN PATENT DOCUMENTS

EP 0 485 897 A1 5/1992

* cited by examiner

*Primary Examiner*—Galen Barefoot
(74) *Attorney, Agent, or Firm*—Venable LLP; Stuart I. Smith

(57) ABSTRACT

A lateral thrust control is provided for influencing the flight trajectory of a projectile. The control has a main control unit; a central, axially extending main recess in the main control unit; a plurality of thruster recesses in the main control unit for accepting correction thrusters; an ignition element for one of the correction thrusters disposed in each of the thruster recesses; and at least one tubular conductor support of an electrically insulating material arranged inside the main recess of main control unit. At least some of the electrical conductors are in the form of conductive tracks fixedly arranged on the at least one tubular conductor support such that a particular contact element for a particular ignition element contacts the conductive track assigned to the particular contact element.

8 Claims, 2 Drawing Sheets

LATERAL THRUST CONTROL

CROSS REFERENCE TO RELATED APPLICATION

This application claims the priority of German Patent Application, DE 103 54 098.9 filed Nov. 19, 2003, which is incorporated herein by reference.

BACKGROUND OF THE INVENTION

The invention relates to a lateral thrust control for influencing the flight trajectory of a projectile.

SUMMARY OF THE INVENTION

It is an object of the present invention to provide a lateral thrust control for influencing the flight trajectory of a projectile. The control has a main control unit having an internal surface; a central, axially extending main recess in the main control unit; a plurality of thruster recesses in the main control unit for accepting correction thrusters; an ignition element for one of the correction thrusters disposed in each of the thruster recesses, each of the ignition elements being provided with at least one contact element for connecting via a conductor to an electronic control unit; and at least one tubular conductor support of an electrically insulating material arranged inside the main recess of main control unit, the at least one tubular conductor support being non-rotating and immovable relative to the main control unit, wherein at least some of the electrical conductors are in the form of conductive tracks fixedly arranged on the at least one tubular conductor support such that a particular contact element for a particular ignition element contacts the conductive track assigned to the particular contact element. The contact elements of the respective ignition elements disposed inside the thruster recesses project into the main recess.

The invention relates to a lateral thrust control for influencing the flight trajectory of a projectile. The control has a control unit with several recesses for correction thrusters, wherein each recess is provided with an ignition element for the respective correction thruster and wherein each of the ignition elements is provided with at least one contact element which can be connected via an electrical connection to an electronic control unit.

With some known lateral control devices, the contact elements for the ignition elements are initially connected via cables. The cables are then threaded into a central, axially extending recess in the control unit, as a rule through radial bores in the control unit, and the ignition elements are screwed into the control unit.

Known lateral thrust controls among other things have the disadvantage of requiring an extremely time-consuming assembly of the ignition elements and their electrical connection to the electronic control unit. In particular, if the lateral control comprises a large number of correction thrusters (for example, up to 180 correction thrusters), an extraordinary amount of time is required for the assembly because of the limited space conditions inside the control unit. In addition, a twisting of the individual cables during the screwing-in of the ignition elements can easily lead to cable breakage, e.g. in the contact region for the respective ignition element. Finally, a check of the electrical connection during the connecting of the cable to the electronic control unit is difficult because the contact elements are no longer accessible once the ignition elements are screwed in.

It is therefore an object of the present invention to disclose a lateral-thrust control of the aforementioned type for which the electrical connection between the ignition elements and the electronic control unit can be installed easily and safely.

Additional and particularly favorable embodiments of the invention are also disclosed.

The invention calls for replacing the electric cables connected to the ignition elements with conductive tracks that are rigidly mounted on tube-shaped conductor supports which are arranged non-rotating and immovable inside the control unit recesses. These conductive tracks make contact with the contact elements only when the ignition elements are screwed or plugged into the recesses of the control unit.

The conductive tracks can be affixed in the traditional way to the conductor supports (for example, with a galvanizing technique or by gluing on the conductive track foils).

With a first embodiment of the invention, the ignition elements of the lateral thrust control are provided for safety reasons with respectively two contact elements and are therefore also connected via two conductive tracks to the electronic control unit. This embodiment provides for two telescoping conductor supports, which can be secured non-rotating and immovable in the end position, wherein respectively one of the two conductive tracks is fixedly arranged on each support. They are arranged in such a way that during the screwing in of an ignition element, one of the contact elements establishes contact with the conductive track on the first conductor support that is adjacent to the ignition element and the respective other contact element is guided through the first conductor support and makes contact with the corresponding conductive track on the second conductor support.

For an easy check of the conductive tracks, it has proven advantageous if the two conductor supports are secured within the control unit recess in such a way that the two conductive tracks, assigned to the respective ignition element, are arranged in a radial direction as close as possible to each other.

The lateral thrust control of a different embodiment of the invention is provided with ignition elements having respectively a first rod-shaped contacting element and a second cylindrical contact element that encloses the rod-shaped contact element, but has a shorter length. In this embodiment, the first conductive track arranged on the first conductor support makes contact with a partial region of the cylindrical contact element of the respective ignition element. In addition, in the region where the rod-shaped contact element projects through the first conductor support, the respective first conductive track has a ring-shaped conducting region which does not contact the rod-shaped contact element.

The tube-shaped conductor supports can be molded plastic parts, provided at one end with a bracket-shaped head section that is arranged outside of the control unit recess and extends perpendicular to the longitudinal axis of the control device, e.g. with thereon arranged connections for connecting the conductive tracks to the electronic control unit. In addition, this head section of the conductor supports can be used for a non-rotating and immovable fixation of the conductor supports. Each bracket-shaped head section is provided with at least one bore, through which a pin-shaped or screw-shaped fixing element projects that is connected to the front wall facing the conductor supports.

For insulating the control unit, generally made of metal, and the conductive tracks of the respectively adjacent conductor support, a tubular molded part of electrically insulating material is arranged between the internal surface of the control unit and the adjacent conductor support.

BRIEF DESCRIPTION OF THE DRAWINGS

Further details and advantages of the invention follow from the exemplary embodiments explained below with the aid of Figures, in which.

DETAILED DESCRIPTION OF THE INVENTION

Figure 1:
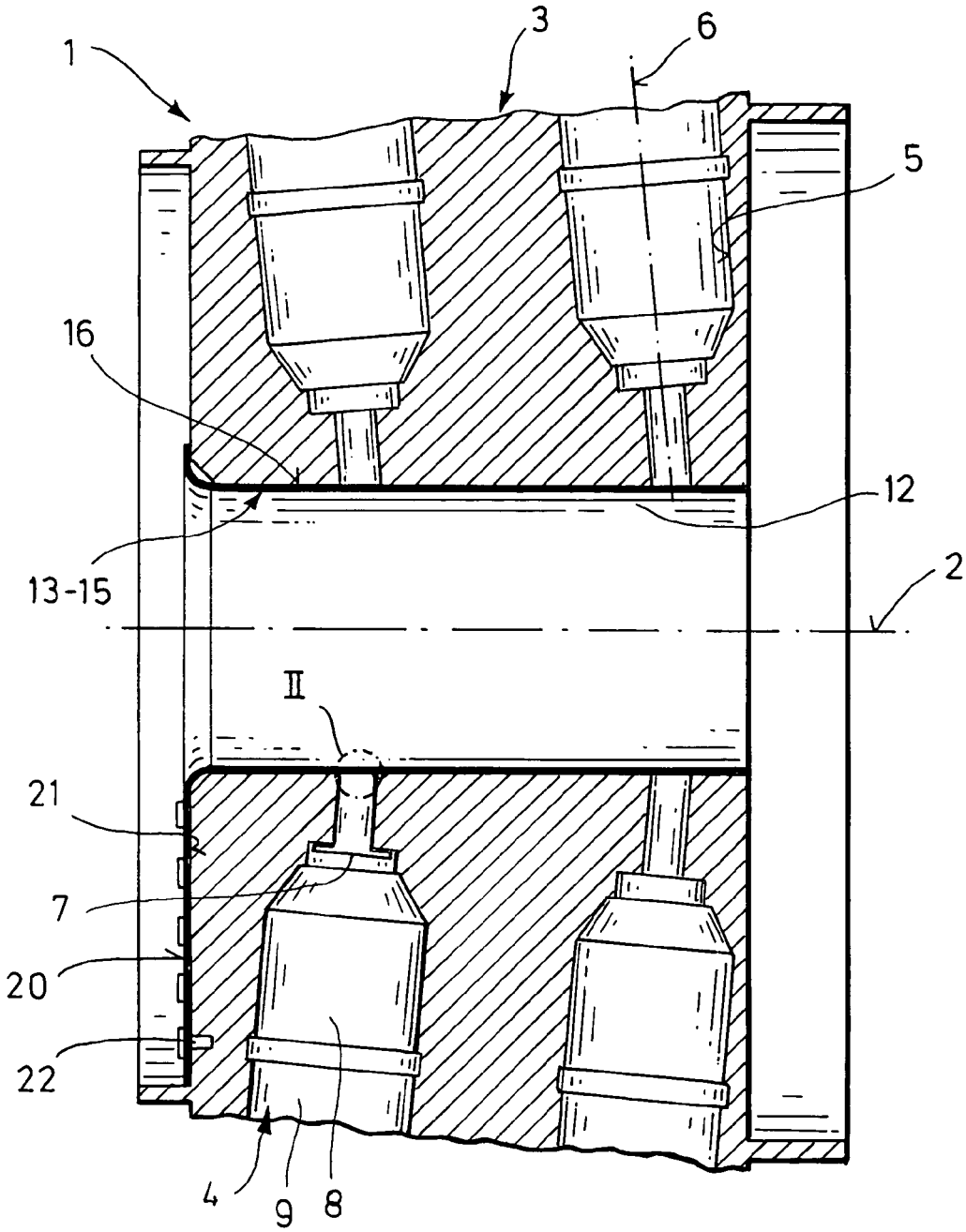
FIG. 1 is a longitudinal section through a schematically shown lateral thrust control according to the invention.

Reference number 1 in FIG. 1 refers to a lateral thrust control which can be installed, for example, in a ballistic projectile that is not shown herein. In that case, the central longitudinal axis 2 of the control 1 coincides with the longitudinal axis of the respective projectile.

The lateral thrust control 1 comprises a control unit 3 of metal with several correction thrusters 4, distributed over the periphery, which are disposed inside recesses 5. Each recess 5 has a longitudinal axis 6 that is arranged slightly slanted as compared to a radial plane that intersects with the longitudinal axis 2 of the control unit 3.

The correction thrusters 4 essentially comprise an ignition element 7 that can be screwed into the respective recess 5, a propelling charge 8, and a nozzle 9.

Each ignition element 7 of the exemplary embodiment shown herein has two contact elements 10 and 11 (FIG. 2), wherein the first contact element 10 is rod-shaped and the second contact element 11 has a cylindrical shape and encloses the first contact element 10. The first contact element 10 furthermore is longer than the second contact element 11.

The control unit 3 is provided with a centrally located, axially extending recess 12 having a cylindrical or conical design, the contacts elements 10, 11 of the respective ignition element 7 projecting to some degree from the edge into this recess. The recess 12 contains three tubular molded parts 13–15 (FIG. 2), fitted one into the other, which enclose the control unit 3 and are arranged non-rotating and immovable on the control unit 3.

A molded part 13 of an electrically insulating material, e.g. plastic, fits directly against the inner surface 16 of the recess 12 in the control unit 3. The two other molded parts 14 and 15, designed as tubular conductor supports, are disposed inside this first molded part 13. Each of these two conductor supports 14, 15 is a molded part made of an electrically insulating material (e.g. plastic) and is additionally provided on the outside with conductive tracks 17, 18 which respectively make contact with one of the two contact elements 10, 11 of an ignition element 7.

Figure 2:
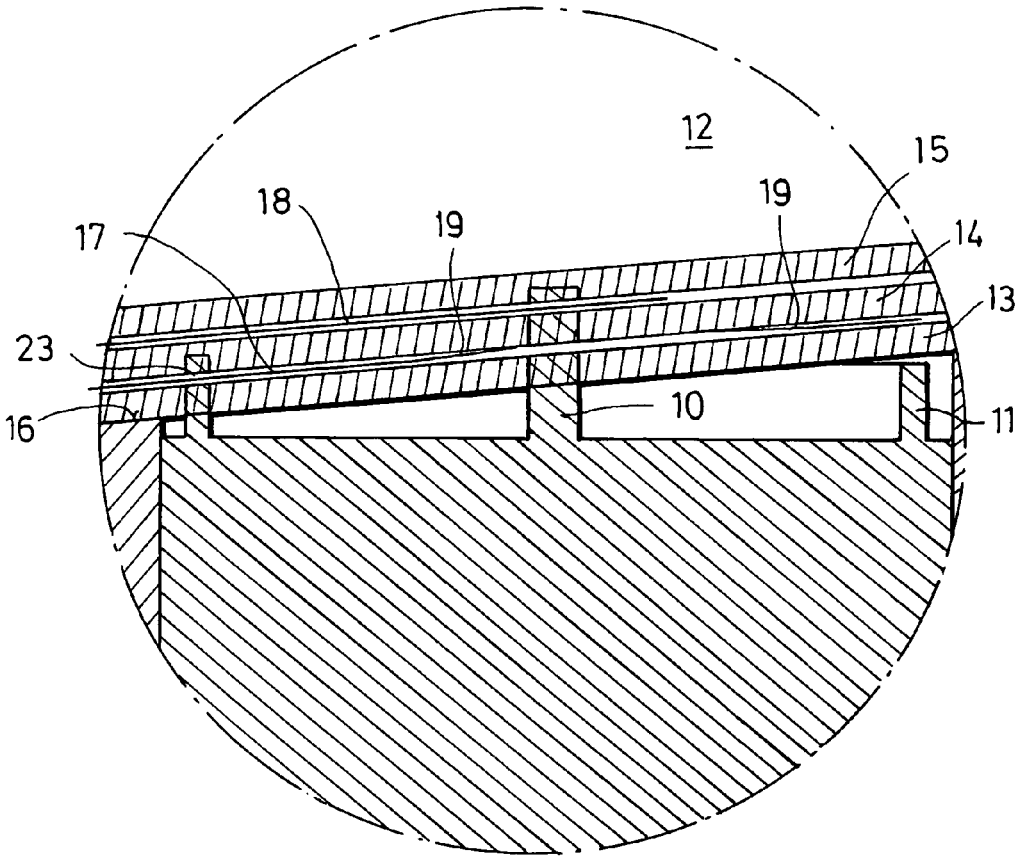
FIG. 2 is an enlarged view of the region of FIG. 1 referenced as II.

FIG. 2 shows that when screwing the ignition element 7 into the recess 5, the cylindrical contact element 11 is pushed through the first molded part 13 and contacts in a partial region 23 the first conductive track 17 of the second molded part 14, which is assigned to this contact element 11. The rod-shaped contact element 10 of the ignition element 7 on the other hand is pushed through the first molded part 13 as well as through the second molded part 14 and contacts the second conductive track 18 of the third molded part 15, which is assigned to this contacting element 10, wherein the first conductive track 17 and the second conductive track 18 are arranged one above the other. To keep the first contact element 10 from also contacting the first conductive track 17, this conductive track 17 is provided with a ring-shaped conducting region 19 that does not touch the first contact element 10 in the region where the first contact element 10 projects through the first conductor support 14.

To position the three molded parts 13–15 in peripheral direction, these are respectively provided at one end with a bracket-shaped head section 20, arranged outside of the recess 12 of control unit 3, which extends perpendicular to the longitudinal axis 2 of the control 1. The respective head section 20 is supported on one front surface 21 of the control unit 3 and contains a bore through which the shaft of a screw 22 extends as positioning element. In addition to positioning the molded parts 13–15 in the peripheral direction, the screw 22 therefore also secures these parts in the axial direction.

Of course, the invention is not limited to the above-described exemplary embodiment. For example, one of the two conductor supports can be omitted if the ignition element is provided with only one contact element that extends toward the outside (in that case, the second electrical connection can be to a ground).

If the control unit is made of an electrically insulating material (e.g. glass-fiber reinforced plastic), the first molded part can be omitted since no insulation is required between the first conductive track and the internal surface of the control unit.

When using ignition elements having several contact elements, these can also be connected to adjacent conductive tracks on the same conductor support.

Instead of individual tubular, concentrically arranged insulating and contact supports, a pre-fabricated multilayer printed circuit board can also be used. In this embodiment, the multiple layers are preferably formed initially on a planar, flexible board which is then bent to form a tube. In the process, the multilayer board can be fitted around a support tube and, if necessary, can also be secured to this tube.

The longitudinal axes 6 of the recesses 5 for the correction thrusters 4 furthermore do not have to be slanted, but can also intersect at a right angle with the longitudinal axis 2 of control unit 3.

To position the conductive tracks in a peripheral direction, relative to the recesses for the ignition elements of the control unit, it is also possible to make a cut in each part, for example. Each cut can be provided with a feather key instead of having bores in the individual molded parts and the control unit through which subsequently a screw or pin is guided.

It is sufficient to simply glue the molded parts to the control unit following the positioning of the molded parts in the peripheral direction since no high forces are generated in the axial direction. However, it would also be conceivable to replace the respective bore in the outer molded part with a plastic bolt that is injection molded thereto and which then can be pressed into the bore in the control unit for a tight fit.

The invention is not limited to the above-described exemplary embodiments. It will be apparent, based on this disclosure, to one of ordinary skill in the art that many changes and modifications can be made to the invention without departing from the spirit and scope thereof.

What is claimed is:

1. A lateral thrust control for influencing the flight trajectory of a projectile, said control comprising:

a main control unit having an internal surface;

a central, axially extending main recess in the main control unit;

a plurality of thruster recesses in the main control unit for accepting correction thrusters;

an ignition element for one of the correction thrusters disposed in each of the thruster recesses, each of the ignition elements being provided with at least one contact element for connecting via a conductor to an electronic control unit; and at least one tubular conductor support of an electrically insulating material arranged inside the main recess of main control unit, the at least one tubular conductor support being non-rotating and immovable relative to the main control unit, wherein at least some of the electrical conductors are in the form of conductive tracks fixedly arranged on the at least one tubular conductor support such that a particular contact element for a particular ignition element contacts the conductive track assigned to the particular contact element, wherein the contact elements of the respective ignition elements disposed inside the thruster recesses project into the main recess.

2. The lateral thrust control according to claim 1, wherein the ignition elements are respectively provided with two contact elements and are connectable via a first conductor track and a second conductive track to the electronic control unit, the lateral thrust control further comprising a first conductor support and a second conductor support which are fittable one into the other and are secured non-rotating and immovable in a final position, with respectively one of the first and second conductive tracks arranged immovably thereon, such that respectively one contact element of the ignition element contacts the first conductive track on the first conductor support that is adjacent to the ignition element and that the respectively other contact element of the ignition element projects through the first conductor support and contacts the conductive track on the second conductor support.

3. The lateral thrust control according to claim 2, wherein the first and second conductor supports are secured inside the main recess of main control unit in such a way that the first and second conductive tracks, assigned to the respective ignition element, are arranged adjacent to each other in a radial direction.

4. The lateral thrust control according to claim 3, wherein the ignition elements are each provided with a first rod-shaped contact element and a second cylindrical contact element which encloses the rod-shaped contact element but is shorter than the rod-shaped contact element, the respectively first conductive track of each ignition element, which is adjacent to an internal surface of the main recess in the main control unit and is arranged on the first conductor support, contacts a partial region of the cylindrical contact element, and the respectively first conductive track in the region where the rod-shaped contact element projects through the first conductor support is provided with a ring-shaped conducting region that does not come in contact with the rod-shaped contact element.

5. The lateral thrust control according to claim 1, wherein the conductor supports are molded plastic parts which are provided with an expanding head section which is arranged outside of the main recess in the main control unit.

6. The lateral thrust control according to claim 1, further comprising a tubular molded part of an electrically insulating material arranged between the internal surface of the main control unit and the first conductor support for insulating the main control unit and the conductive tracks of the adjacent first conductor support.

7. The lateral thrust control according to claim 1, wherein the conductor supports respectively are sections of a tube-shaped multilayer circuit board.

8. The lateral thrust control device according to claim 6, wherein for positioning the tubular conductive supports in a peripheral direction, their head sections are respectively provided with a bore through which at least one pin-shaped or screw-shaped positioning element is extendable and connectable to fronts of the main control unit that faces the head sections.

* * * * *